United States Patent [19]

Branovich et al.

[11] Patent Number: 4,872,864

[45] Date of Patent: Oct. 10, 1989

[54] METHOD OF MAKING A CATHODE FROM TUNGSTEN AND ALUMINUM POWDERS

[75] Inventors: Louis E. Branovich, Howell; Bernard Smith, Ocean; Gerard L. Freeman, Freehold; Donald W. Eckart, Wall, all of N.J.

[73] Assignee: The United States of America as represented by the Secretary of the Army, Washington, D.C.

[21] Appl. No.: 313,837

[22] Filed: Feb. 23, 1989

[51] Int. Cl.[4] ..... H01J 9/04

[52] U.S. Cl. ..... 445/50

[58] Field of Search ..... 445/50, 51

[56] References Cited

U.S. PATENT DOCUMENTS

| | | | |
|---|---|---|---|
| 4,273,683 | 6/1981 | Kawamura | 445/51 |
| 4,708,681 | 11/1987 | Branovich et al. | 445/50 |
| 4,735,591 | 10/1988 | Branovich et al. | 445/50 |

FOREIGN PATENT DOCUMENTS

| | | | |
|---|---|---|---|
| 222564 | 7/1958 | Australia | 445/50 |

*Primary Examiner*—Kenneth J. Ramsey

*Attorney, Agent, or Firm*—Michael J. Zelenka; Roy E. Gordon

[57] ABSTRACT

A cathode is made from a mixture of tungsten and aluminum powders.

8 Claims, No Drawings

METHOD OF MAKING A CATHODE FROM TUNGSTEN AND ALUMINUM POWDERS

The invention described herein may be manufactured, used, and licensed by or for the Government for governmental purposes without the payment to us of any royalty thereon.

This invention relates in general to a method of making a cathode for operation in microwave devices and in particular to a method of making a cathode for operation in microwave devices from tungsten and aluminum powders.

BACKGROUND OF THE INVENTION

Heretofore, cathodes suitable for operation in microwave devices have been made from mixtures of tungsten and iridium powders. The manufacture of such cathodes is described and claimed for example in U.S. Pat. No. 4,708,681 issued 11/24/87 and U.S. Pat. No. 4,735,591 issued 04/05/88.

A difficulty with such cathode manufacture is the relatively high cost of iridium.

SUMMARY OF THE INVENTION

The general object of this invention is to reduce the cost of the method of making a long life high current density cathode. A more particular object of the invention is to provide such a method wherein the resulting cathode will be suitable for use in microwave devices.

It has now been found that the aforementioned objects can be attained by forming a porous billet from a mixture of tungsten and aluminum powders and then impregnating the billet with a lower melting point impregnant.

More particularly, according to the invention, a long life high current density cathode suitable for operation in microwave devices is made from a mixture of tungsten and aluminum powders by a method including the steps of:

(A) mixing tungsten and aluminum powders in a weight ratio of 40 to 64 weight percent tungsten to 60 to 36 weight percent aluminum, (B) adding 1 percent by weight of zirconium hydride to the mixture, (C) ball milling the mixture for about 8 hours, (D) pressing the ball milled mixture into a billet at about 48,000 p.s.i. in a die, (E) sintering the billet at 700° C. to 1325° C. for ½ hour in dry hydrogen of less than −100 dewpoint, (F) backfilling the billet with methyl methacrylate, (G) machining the billet to the desired geometry, (H) removing the methyl methacrylate by dissolution in acetone, (I) thoroughly rinsing in deionized water, methanol and then drying, (J) firing the billet in dry hydrogen at about 700° C. to 1325° C. for about 15 minutes, (K) impregnating the billet with a lower melting point impregnant by firing the billet in a dry hydrogen furnace at a temperature at which the impregnant melts for about two minutes, (L) removing the billet from the furnace after the furnace is cooled, and (M) removing any loose pieces of impregnant from the billet.

As the lower melting point impregnant, one may use barium aluminate or a mixture of barium peroxide with aluminum or a mixture of barium peroxide with aluminum oxide.

The operation of a tungsten billet with barium aluminate as the impregnant involves the decomposition of the barium aluminate to form barium oxide according to the reaction:

$$Ba_3Al_2O_6 \rightarrow BaAl_2O_4 + 2BaO$$

The barium oxide formed would then react with the wall of the tungsten billet to form barium metal according to the reaction:

$$6BaO + W \rightarrow Ba_3WO_6 + 3Ba$$

If aluminum is added to the billet during the manufacture of the billet and $Ba_3Al_2O_6$ is the impregnant, then the reaction of the tungsten-aluminum billet would be the combination of the two reactions:

$$6BaO + 2Al \rightarrow Ba_3Al_2O_6 + 3Ba \qquad Eq_x$$
$$6BaO + W \rightarrow Ba_3WO_6 + 3Ba \qquad Eq_y$$

Since $Eq_x$ proceeds at a more rapid rate than $Eq_y$, more generation of Ba would be expected at a constant temperature and a constant concentration of $Ba_3Al_2O_6$ impregnant per constant time. A higher current density would result. Higher current densities at equal amounts of impregnant would occur at a lower temperature for the tungsten-aluminum impregnated cathode.

Aluminum powder or aluminum oxide powder can also be used during impregnation of a lower melting point impregnant such as barium peroxide. In such an instance, the molar ratio of the barium peroxide to aluminum should be greater than three to two since a 3:2 molar ratio would yield 1 mole of barium aluminate impregnant according to the reaction:

$$3BaO_2 + 2Al \rightarrow Ba_3Al_2O_6$$

without free aluminum to enter the reaction as illustrated in $Eq_x$ above.

Small portions of iridium, rhodium, ruthenium and osmium can also be added.

DESCRIPTION OF THE PREFERRED EMBODIMENT

A long lived high current density cathode is made in the following manner. Tungsten and aluminum powders are mixed in a weight ratio of 60 weight percent tungsten to 39 weight percent aluminum. 1 percent by weight of zirconium hydride activator is added to the mixture and the mixture ball milled for about 8 hours. The ball milled mixture is then pressed into a billet at about 48,000 p.s.i. in a die and the billet then sintered at 1325° C. for ½hour in dry hydrogen of less than −100 dewpoint. The billet is then backfilled with methyl methacrylate, the billet machined to the desired geometry, and the methyl methacrylate then removed by dissolution in acetone The porous billet is then thoroughly rinsed in deionized water, methanol and then dried. The billet is then hydrogen fired at about 1200° C. for about 15 minutes. The billet is then impregnated with barium aluminate by firing the billet in a hydrogen furnace at about 1000° C. for two minutes. The billet is removed from the furnace after the furnace is cooled and loose particles of impregnant are removed from the billet using a jeweler's lathe and fine alumina cloth.

The resulting cathode is then mounted in a test vehicle and activated using standard matrix cathode activation procedures. The cathode gives current densities of 100 A/cm$^2$ at 1200° C.

The rate of barium atom formation is much faster at the same operating temperature in the case of the tungsten-aluminum billet than the tungsten-iridium billet or the normal tungsten billet.

In the method of the invention, a small amount of an activator as, for example, zirconium hydride is included in the billet The activator enhances the generation of barium atoms at the cathode operating temperature.

We wish it to be understood that we do not desire to be limited to the exact details of construction as described for obvious modifications will occur to a person skilled in the art.

What is claimed is:

1. Method of making a cathode for operation in microwave devices from tungsten and aluminum powders, said method including the steps of:

(A) mixing the tungsten and aluminum powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 700° to 1325° C. for about thirty minutes in dry hydrogen of less than −100 dewpoint,
(F) backfilling the billet with methyl methacrylate,
(G) machining the billet to the desired geometry,
(H) removing the methyl methacrylate by dissolution in acetone,
(I) thoroughly rinsing in deionized water, methanol and then drying,
(J) firing the billet in dry hydrogen at about 700° to 1325° C. for about 15 minutes,
(K) impregnating the billet with an impregnant having a melting point less than or equal to 1000° C. by firing the billet in a dry hydrogen furnace at a temperature at which the impregnant melts for about two minutes,
(L) removing the billet from the furnace after the furnace is cooled, and
(M) removing any loose pieces of impregnant from the billet.

2. Method of making a cathode according to claim 1 wherein in step (A), the tungsten and aluminum powders are mixed in a weight ratio of about 60 weight percent tungsten to about 39 weight percent aluminum.

3. Method of making a cathode according to claim 1 wherein in step (B), the activator is about 1 weight percent zirconium hydride.

4. Method of making a cathode for operation in microwave devices from tungsten and aluminum powders, said method including the steps of:

(A) mixing the tungsten and aluminum powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 700° to 1325° C. for about thirty minutes in dry hydrogen of less than −100 dewpoint,
(F) backfilling the billet with methyl methacrylate,
(G) machining the billet to the desired geometry,
(H) removing the methyl methacrylate by dissolution in acetone,
(I) thoroughly rinsing in deionized water, methanol and then drying,
(J) firing the billet in dry hydrogen at about 700° to 1325° C. for about 15 minutes,
(K) impregnating the billet with an impregnant having a melting point less than or equal to 1000° C. and selected from the group consisting of barium aluminate, a mixture of barium peroxide with aluminum, and a mixture of barium peroxide with aluminum oxide, by firing the billet in a dry hydrogen furnace at a temperature at which the impregnant melts for about two minutes,
(L) removing the billet from the furnace after the furnace is cooled, and
(M) removing any loose pieces of impregnant from the billet.

5. Method of making a cathode for operation in microwave devices from tungsten and aluminum powders, said method including the steps of:

(A) mixing the tungsten and aluminum powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 700° to 1325° C. for about thirty minutes in dry hydrogen of less than −100 dewpoint,
(F) backfilling the billet with methyl methacrylate,
(G) machining the billet to the desired geometry,
(H) removing the methyl methacrylate by dissolution in acetone,
(I) thoroughly rinsing in deionized water, methanol and then drying,
(J) firing the billet in dry hydrogen at about 700° to 1325° C. for about 15 minutes,
(K) impregnating the billet with barium aluminate having a melting point less than or equal to 1000° C. by firing the billet in a dry hydrogen furnace at a temperature at which the impregnant melts for about two minutes,
(L) removing the billet from the furnace after the furnace is cooled, and
(M) removing any loose pieces of impregnant from the billet.

6. Method of making a cathode for operation in microwave devices from tungsten and aluminum powders, said method including the steps of:

(A) mixing the tungsten and aluminum powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 700° to 1325° C. for about thirty minutes in dry hydrogen of less than −100 dewpoint,
(F) backfilling the billet with methyl methacrylate,
(G) machining the billet to the desired geometry,
(H) removing the methyl methacrylate by dissolution in acetone,
(I) thoroughly rinsing in deionized water, methanol and then drying,
(J) firing the billet in dry hydrogen at about 700° to 1325° C. for about 15 minutes,
(K) impregnating the billet with a mixture of barium peroxide with aluminum having a melting point less than or equal to 1000° C. by firing the billet in a dry hydrogen furnace at a temperature at which the impregnant melts for about two minutes, (L) removing the billet from the furnace after the furnace is cooled, and (M) removing any loose pieces of impregnant from the billet.

7. Method of making a cathode for operation in microwave devices from tungsten and aluminum powders, said method including the steps of:

(A) mixing the tungsten and aluminum powders, (B) adding about 2 percent by weight of an activator to the mixture, (C) ball milling the mixture for about 8 hours, (D) pressing the ball milled mixture into a billet at about 48,000 p.s.i. in a die, (E) sintering the billet at about 700° to 1325° C. for about thirty minutes in dry hydrogen of less than −100 dewpoint, (F) backfilling the billet with methyl methacrylate, (G) machining the billet to the desired geometry, (H) removing the methyl methacrylate by dissolution in acetone, (I) thoroughly rinsing in deionized water, methanol and then drying, (J) firing the billet in dry hydrogen at about 700° to 1325° C. for about 15 minutes, (K) impregnating the billet with a mixture of barium peroxide with aluminum oxide having a melting point less than or equal to 1000° C. by firing the billet in a dry hydrogen furnace at a temperature at which the impregnant melts for about two minutes, (L) removing the billet from the furnace after the furnace is cooled, and (M) removing any loose pieces of impregnant from the billet.

8. Method of making a cathode for operation in microwave devices from tungsten and aluminum powders said method including the steps of:

(A) mixing the tungsten and aluminum powders in the weight ratio of about 60 weight percent tungsten to about 39 weight percent aluminum, (B) adding about 1 percent by weight of zirconium hydride to the mixture, (C) ball milling the mixture for about 8 hours, (D) pressing the ball milled mixture into a billet at about 48,000 p.s.i. in a die, (E) sintering the billet at about 1325° C. for about thirty minutes in dry hydrogen of less than −100 dewpoint, (F) backfilling the billet with methyl methacrylate, (G) machining the billet to the desired geometry, (H) removing the methyl methacrylate by dissolution in acetone, (I) thoroughly rinsing in deionized water, methanol and then drying, (J) firing the billet in dry hydrogen at about 1200° C. for about 15 minutes, (K) impregnating the billet with barium aluminate by firing the billet in a dry hydrogen furnace at about 1000° C. for about two minutes, (L) removing the billet from the furnace after the furnace is cooled, and (M) removing any loose pieces of impregnant from the billet.

* * * * *